United States Patent [19]

Culhane

[11] 4,250,640

[45] Feb. 17, 1981

[54] PICTURE FRAMES

[76] Inventor: Vernon C. Culhane, 2729 County Rd. 228, Durango, Colo. 81301

[21] Appl. No.: 927,874

[22] Filed: Jul. 25, 1978

[51] Int. Cl.[3] ..... G09F 1/12
[52] U.S. Cl. ..... 40/155
[58] Field of Search ..... 40/19.5, 159, 156, 152, 40/16, 10 B, 155

[56] References Cited

U.S. PATENT DOCUMENTS

| | | | |
|---|---|---|---|
| 1,510,494 | 10/1924 | Gurley | 40/19.5 |
| 2,663,105 | 12/1953 | Woodbury | 40/152 |
| 3,654,719 | 4/1972 | Rochelt | 40/156 |
| 4,000,571 | 1/1977 | Harrison | 40/19.5 |

FOREIGN PATENT DOCUMENTS

| | | | |
|---|---|---|---|
| 1059252 | 3/1954 | France | 40/159 |

*Primary Examiner*—F. Barry Shay
*Assistant Examiner*—Wenceslao J. Contreras
*Attorney, Agent, or Firm*—Harvey B. Jacobson

[57] ABSTRACT

A frame for supporting a transparent holder provided with at least one pocket for retaining and positioning a photograph, and the like, has a support member including a planar support surface arranged for supporting the holder, and a device provided on the support member for retaining the holder. In most instances, the positioning device comprising a plurality of pins arranged for being received in the apertures conventionally provided on the transparent holder, although strips of material provided with a contact adhesive can be employed for gripping the holder, either in conjunction with or independently of the pins.

1 Claim, 18 Drawing Figures

58
54
58
60
60
56

11
62
70
11
68
72
74
74
64

68
72
70
66
74
74

80
13
76
82'
13
88
88
78

80
84
82'
82
84'
78
90
86
86'
10

102
94
15
98
96
96
102
92
15

102
100
96
94
10
98
102

108
106
106
10
104

112
116
110
114

120
122
14
124
118
10

PICTURE FRAMES

BACKGROUND OF THE INVENTION

1. Field of the Invention

This invention relates generally to the framing of pictures, a particularly to the mounting of transparent holders, such as commonly employed for photo album pages, in such a manner as to permit display of photographs, and the like, inserted in pockets of the holder on a wall, tabletop, and the like.

2. Description of the Prior Art

It is well known to use album pages constructed from a polyvinyl chloride resin with one or more transparent pockets formed therein for holding photographs, slides, negatives, and the like. These album pages, which are usually provided with three uniformly spaced apertures and are suitable for insertion into standard 3-ring binders, and the like, permit photographs to be mounted in a simple yet versatile manner. Prints are easily inserted in these pages, where they are protected while they can show their brilliance. Such pages can be viewed singly, and can be quickly arranged and rearranged in binders.

There are also available such transparent picture holders which are provided with a multiplicity of closely spaced apertures for receiving a spiral binding.

A problem encountered with the conventional mounting of pictures for display on walls, bookcases, and the like, is that it is rather difficult to replace one picture with another when a change is desired. Pictures tend to displayed too long, while some pictures which should be displayed are never put out. Thus, there is need for picture frames which will permit rapid and convenient mounting and replacement of photographs for wall and display.

U.S. Pat. No. 2,963,809, issued Dec. 13, 1960 to B. L. Parker, discloses photoprint mounts provided with openings for being mounted in binders, and the like, in the conventional manner as discussed above. Further, U.S. Pat. No. 3,797,152, issued Mar. 19, 1974 to E. R. Brandt, discloses a photograph album page which employs overlapping sheets to form a single page in such a manner and photographs are retained in their proper positions relative to apertures provided in the sheets, while U.S. Pat. No. 2,639,526, issued May 26, 1953 to A. J. Bepristis, discloses an album in which the pages are arranged such as any of a plurality of photographs can be maintained in display mode for an indefinite period of time.

U.S. Pat. No. 3,347,134, issued Oct. 17, 1967 to H. Neiwin, discloses a slide mount for film transparencies which comprises a pair of cooperating halves which snap together to hold a transparency between them, while U.S. Pat. No. 3,486,263, issued Dec. 30, 1969 to S. A. Larsson, discloses a mounting frame similar to that of Pat. No. 3,347,134 in that a pair of halves are snapped together in order to hold a transparency between them. U.S. Pat. No. 3,973,344, issued Aug. 4,1976 to H. Frankell, discloses a multi-image slide mount which is similar to the two previously discussed prior patents, inasmuch as it also employs a pair of cooperating parts to grip the transparency, but is provided with a plurality of windows in order to permit the simultaneous viewing of all of the images of a multi-image film strip.

U.S. Pat. No. 3,707.053, issued Dec. 26, 1972 to T. Itano, discloses a picture support which enables one to display a picture with a transparent flat panel supported on a back planel by use of concealed connectors in the form of pins received in apertures provided in the back panel.

SUMMARY OF THE INVENTION

It is an object of the present invention to provide picture frames specifically intended for mounting the conventional transparent image-holders in such a manner as to permit display of images retained by the holder on walls, bookshelves, tabletops, and the like.

It is another object of the present invention to provide picture frames primarily intended for mounting photographs, and the like, in such a manner as to permit their rapid and convenient replacement, while permitting the photographs to be displayed on walls, bookcases, tabletops, and the like.

A still further object of the present invention is to provide picture frames which permit the use of the conventional transparent image-holders such as commonly employed for photograph album pages, and the like, to be used to hold photograph in such a manner as to permit wall and tabletop display of the photographs.

These and other objects are achieved according to the present invention by providing a picture frame having, a support member including a planar support surface arranged for supporting a conventional transparent image-holder; and a positioning arrangement provided on the support member and extending from the planar surface for engaging the transparent image-holder and retaining the holder on the support surface. In particular, the retaining arrangement is contemplated to be a plurality of pins which engage with the conventionally provided apertures of the commonly used photo album pages, and the like.

A wire hanger or stand may be employed with the support member of the frame, so as to extend away from the support surface of the support member, in order to permit the frame to either hang from a wall or be disposed on a horizontal surface such as a tabletop, bookcase, and the like.

A clamp device can be associated with the pins at the upper portion of the support member for assuring that the image-holder will remain on the pins. An actuating handle of such a clamp can be used to provide a side front rail of the frame in addition to facilitating opening of the clamp against the bias of torsion-spring hinges, and the like, included in the clamp assembly.

Strips of magnetized material or a contact adhesive can be disposed on the support surface of the support member for also cooperating with the pins to assure retention of the image-holder on the support member. Magnetic album pages, those with an opaque stiff backboard and transparent covering, can be used in conjunction with the magnetic strips.

A hinge can be mounted along the upper or torque portion of the support surface of the support member and retained thereon as by suitable pieces of material provided with a contact adhesive so as to retainingly grip and upper edge portion of the image-holder and retain same on the support member, with or without the cooperation of pins provided on the support member.

Suitable front edging can be used with any of the embodiments as desired to finish off the frame.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
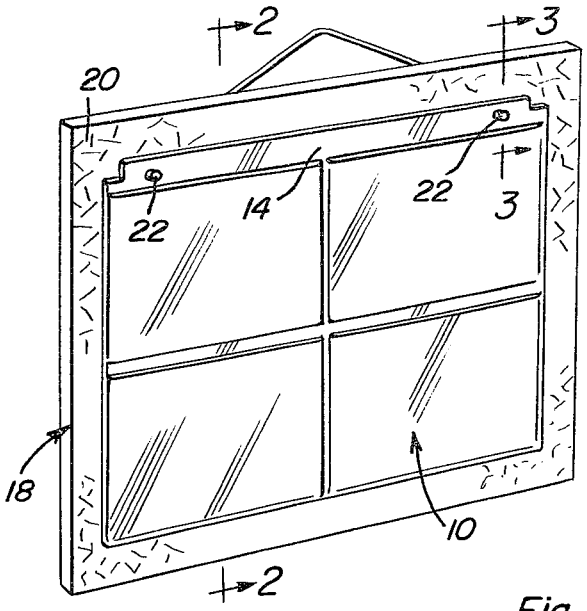
FIG. 1 is a prospective view showing a first embodiment of a picture frame according to the present invention.
Figure 2:
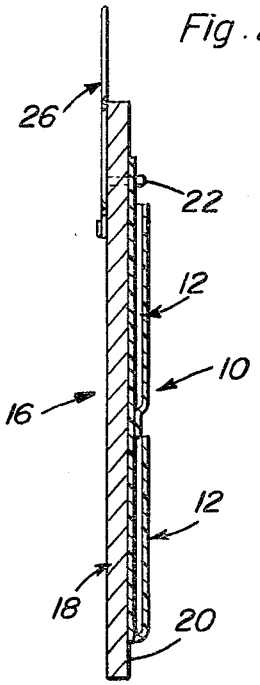
FIG. 2 is an enlarged, sectional view taken generally along the line 2—2 of FIG. 1.
Figure 3:
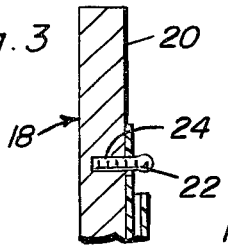
FIG. 3 is an enlarged, fragmentary, sectional view taken generally along the line 3—3 of FIG. 1, and showing in detail the manner in which pins are disposed in the support member of the picture frame shown in FIGS. 1 and 2.

Referring now more particularly to FIG. 1-3 of the drawings, a transparent image-holder 10, which is illustrated as having four pockets 12, is provided in the conventional manner with three apertures 14 normally intended for receiving the ring portions (not shown) of a conventional 3-ring binder. Such image-holder 10 are well known and commonly used, and therefore will not be described in greater detail herein. Image-holder 10 is in combination with a picture frame 16 according to the present invention, which frame 16 permits image-holder 10 to be mounted on a wall, and the like.

Figure 4:
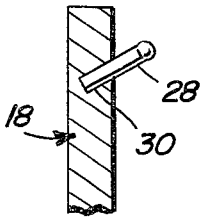
FIG. 4 is a fragmentary, sectional view, similar to FIG. 3, but showing a modified arrangement of pins relative to an associated support member of a picture frame according to the present invention.

Frame 16 includes a generally planar support member 18 of rectangular configuration and including a planar support surface 20 formed by one face thereof. Support surface 20 can be textured in order to enhance the aesthetic appeal of frame 16. A plurality of pins 22, preferably provided with enlarged heads, are disposed along the top edge, or what is intended to be the top edge, of support member 18, and are mounted on support member 18 as by sockets 24 provided therein so as to extend outwardly away from support surface 20. A wire hanger 26 can be attached to the face of support member 18 which is parallel to, but spaced from, support surface 20, for permitting frame 16 to be hung on a wall, and the like, in the conventional manner (not shown). As can be appreciated, in the embodiment seen in FIGS. 1-3, image-holder 10 is retained on support member 18 merely by placing the apertures 14 of image-holder 10 over the pins 22, with the heads provided on pins 22 helping to assure that image-holder 10 will not slide off of the pins 22. In the modified embodiment of frame 16 as seen in FIG. 4, pins 28 are mounted at an upwardly inclined angle by the downwardly inclined sockets 30 provided in the support member so as to further assure that image-holder 10 will be retained in place on support member 18'.

Figure 5:
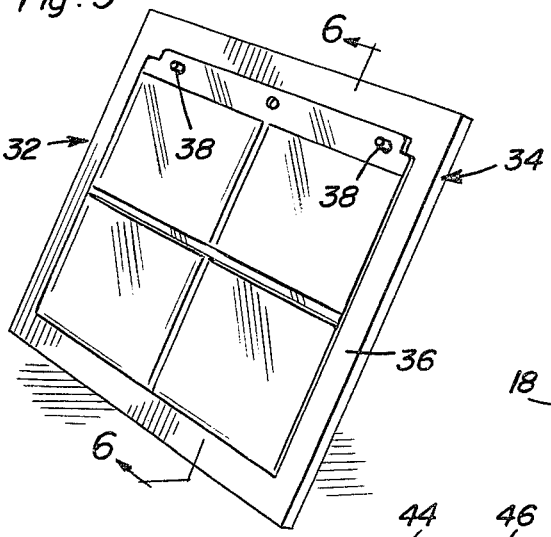
FIG. 5 is a perspective view showing a second embodiment of a picture frame according to the present invention.
Figure 6:
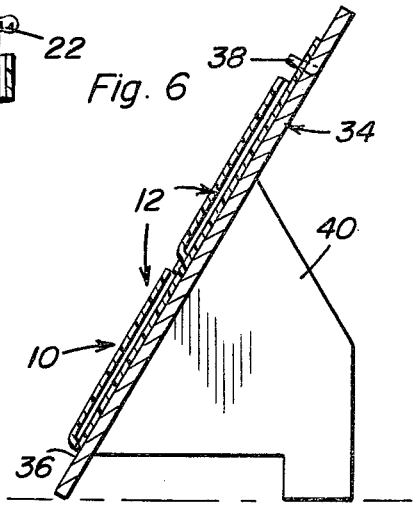
FIG. 6 is an enlarged, sectional view taken generally along the line 6—6 of FIG. 5.

Referring now more specifically to FIGS. 5 and 6 of the drawings, a frame 32 according to the invention includes a support member 34 similar to support member 18 and having a support surface 36 from which extend a plurality of pins 38, but having extending rearwardly from support member 34 a leg 40 which forms a stand for support member 34 by bracing support member 34 against pivotal movement about its lower edge.

Figure 7:
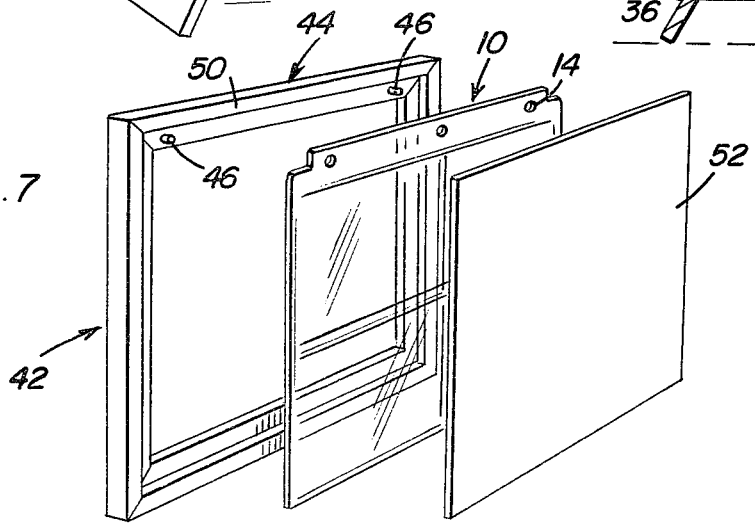
FIG. 7 is an exploded, perspective view showing a third embodiment of a picture frame according to the present invention.
Figure 8:
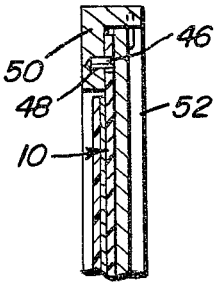
FIG. 8 is an enlarged, fragmentary, vertical sectional view taken through the upper portion of the picture frame seen in FIG. 7.

FIGS. 7 and 8 of the drawings show a frame 32 including a support member 44 in the form of a rectangular open framework and provided with a plurality of pins 46, two being illustrated, disposed in associated sockets 48 provided in a top rail 50 of framework 44. Once image-holder 10 is retained on pins 46, a piece of rectangular glazing 52 can be placed over image-holder 10 and mounted on support member 44 in a conventional manner which is well known in the picture framing art and will not be describerd in detail herein.

Figures 9, 10, 11, 12, 13, 14, 15, 16, 17, 18:
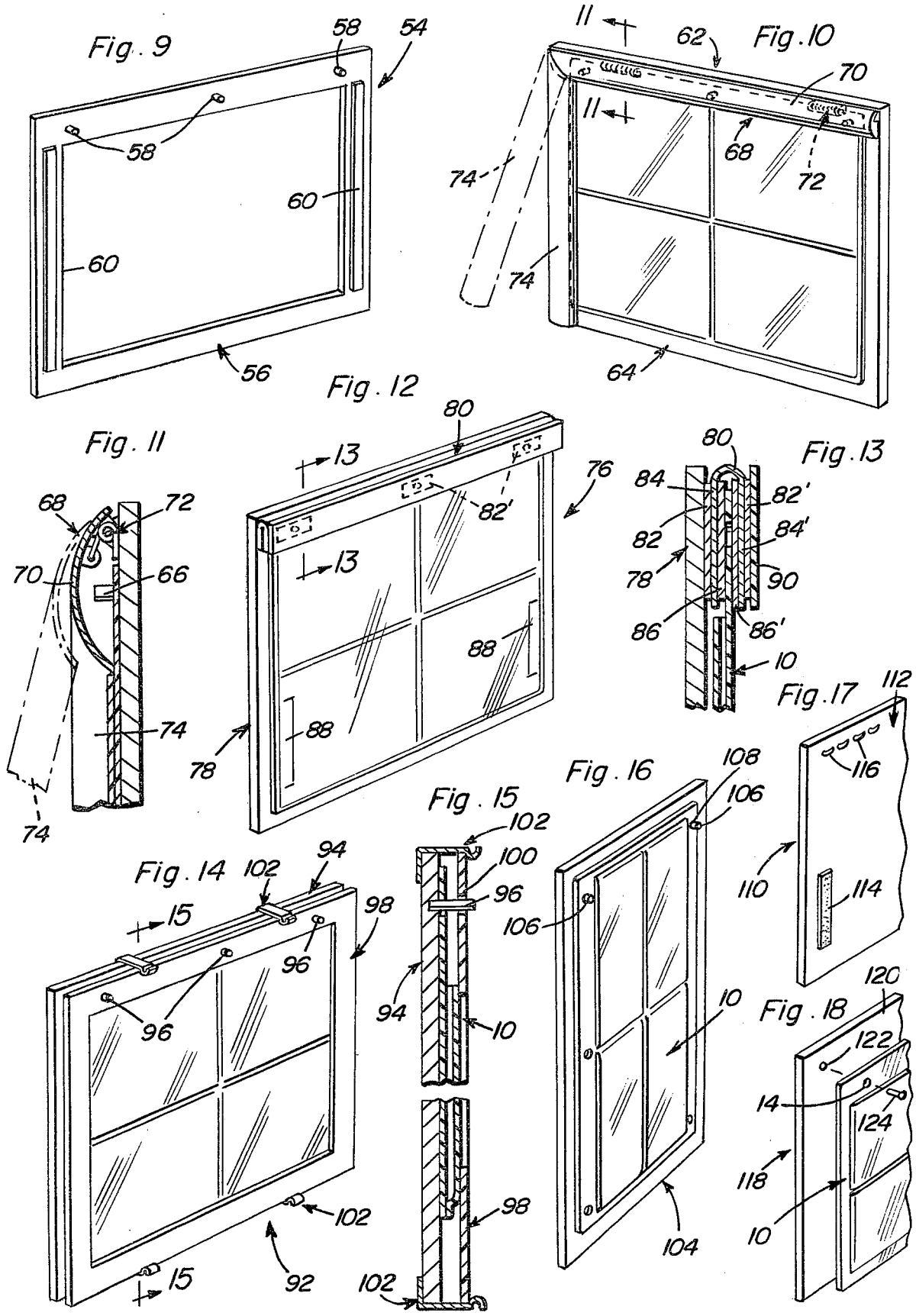
FIG. 9 is a perspective view showing yet another embodiment of a picture frame according to the present invention.
FIG. 10 is a perspective view showing still another embodiment of a picture frame according to the present invention.
FIG. 11 is an enlarged, fragmentary, sectional view taken generally along the lines 11—11 of FIG. 10.
FIG. 12 is a perspective view showing another embodiment of a picture frame according to the present invention.
FIG. 13 is an enlarged, fragmentary, sectional view taken generally along the line 13—13 of FIG. 12.
FIG. 14 is a perspective view showing another embodiment of a picture frame according to the present invention.
FIG. 15 is an enlarged, sectional view taken generally along the linw 15—15 of FIG. 14.
FIG. 16 is a perspective view showing another embodiment of a picture frame according to the present invention.
FIG. 17 is a fragmentary, perspective view showing yet another embodiment of a picture frame according to the present invention.
FIG. 18 is a fragmentary, perspective view showing still another embodiment of a picture frame according to the present invention.

A frame 54 is illustrated in FIG. 9 of the drawings, and includes a support member 56 which is also rectangular open framework provided with a plurality of pins 58, three being shown, along an upper or top rail thereof. Suitable strips 60 constructed in a known manner from a known magnetic material are disposed along the side rails of support member 50 so as to assure retention of an image-holder 10 (not shown in FIG. 9) on support member 56 in cooperation with the pins 58 engaging the apertures 14 of the image-holder 10.

Referring now more particularly to FIGS. 10 and 11 of the drawings, a picture frame 62 according to the present invention includes a support member 64 provided with a plurality of pins 66, and to this extent is similar to those embodiments of the invention discussed above. Frame 62, however, is provided with a clamp 68 including a jaw 70 pivotally mounted so as to extend along the upper portion of support member 64 and be pivotally retained on support member 64 as by a pair of conventional torsion-spring hinges 72, the coil of which torsion springs forms the pivot axis for actuating jaw 70, and with one of the legs of the torsion spring attached to support member 64 in a conventional manner, and the other of the legs of the springs being attached to a log extending from the inner surface of jaw 70. A handle 74 is connected to one end of jaw 70 and extends perpendicular to the extent thereto so as to simultaneously form a front side rail of frame 62 as well as functioning to facilitate the opening of jaw 70 by a movement shown by broken lines in FIGS. 10 and 11, so as to permit insertion and removal of an image-holder 10 on the pins 66.

A frame 76 is illustrated in FIGS. 12 and 13 as including a support member 78 of generally rectangular configuration and having provided at the upper edge thereof a hinge 80 which retainingly grips in a removal manner the upper edge of an associated image-holder 10.

A suitable strip 82 of a conventional double-faced contact adhesive tape is used to mount a leg 84 of hinge 80 to the support surface of support member 78, while strips 86 and 86' of similar double-faced contact adhesive tape are mounted to the inner faces of legs 84 and 84' of hinge 80 for grippingly retaining the image-holder 10 between them. Although pins are not shown in FIGS. 12 and 13, it is to be understood that pins similar to those employed in the embodiments discussed above could be used in conjunction with hinge 80 to hold image-holder in place if desired. Further, suitable pieces or strips 88 of double-faced contact adhesive tape can be employed in the lower side portion of the support surface of support member 78 for additionally retaining image-holder 10, and preventing same from flapping outwardly of the support member 78. In addition, a front frame top 90 can be placed over legs 84' of hinge 80 to enhance the aesthetic appeal of the resulting picture frame 76 by use of a plurality of pieces or strips 82', similar to strips 82, mounted on the front facing surface of the legs 84' of hinge 80.

FIGS. 14 and 15 illustrate a frame 92 according to the invention which includes a generally rectangular support member 94 provided with a plurality of pins 96, three being shown, and having a front cover 98 provided with openings 100 which match pins 96 for being retainingly received thereon. Suitable spring clamps 102 which fit around the back surface of support member 94 and releasably engage with the peripheral portion of front cover 98, which can have a transparent center or window portion and an opaque periphery, in order to retain front cover 98 on pins 96, and simultaneously hold the image-holder 10 between support member 94 and front cover 98.

FIG. 16 shows a frame having a support member 104 of generally rectangular configuration, but having the longest extent thereof vertical so that when an image-holder 10 is mounted on the pins 106 provided at the upper corners of support member 104, and additional aperture 108 must be provided in the corresponding corner of the immage-holder 10, which aperture is not normally found on album pages, so as permit mounting of the image-holder 10 on the support member 104.

Referring now more particularly to the FIGS. 17 and 18 of the drawings, a picture frame 110 according to the present invention is illustrated in FIG. 17 as including a generally rectangular support member shown as having an adhesive strip 114 along one side thereof provided with a plurality of hooks 116 along the top or upper portion or side so as to receive the closely spaced apertures provided in some photo album pages for normally being bound by the conventional spiral binders (not shown). The frame 118 illustrated in FIG. 18 includes a generally rectangular support member 120 provided with a hole 122 in the upper left corner thereof, with it being understood that there will be at least one other hole in the right corner of support member 120 for receiving a peg 124 having an enlarged head and which passes through the conventionally provided aperture 14 and an image-holder 10 to be fittingly received in the hole 122 in order to retain the image-holder 10 on the support member 120.

As can be readily understood from the above description and from the drawings, the various embodiments of a picture frame according to the present invention will permit the standard image-holders, whether provided with apertures or 3-ring binder mounting, spiral binding, and the like, to be quickly and easily mounted in such a manner as to be hung on a wall supported on a bookcase, a desk top, or any other place where pictures are conventionally displayed.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination with an image-holder having at least one pocket provided with a transparent wall for receiving and displaying an image and having a plurality of apertures, a frame, comprising, in combination:

(a) a support member including a planar support surface arranged for supporting the image-holder; and (b) positioning means provided on the support member and extending from the planar surface for engaging the image-holder and retaining the image-holder on the support member, wherein the positioning means includes a plurality of pins projecting codirectionally from the support surface of the support member for retainingly engaging in the apertures of the image-holder; and gripping means mounted on the support member for releasably engaging the image-holder along a peripheral edge thereof and retaining the image-holder on the support member, wherein said gripping means includes a cover provided with openings for receiving said pins and a plurality of resilient clamps releasably holding said cover against said image-holder, said resilient clamps being attached to the periphery of said support surface and engaging the periphery of said cover, and wherein said cover has an open center area for exposing said image-holder.

* * * * *